United States Patent [19]

Drury

[11] Patent Number: 4,652,244

[45] Date of Patent: Mar. 24, 1987

[54] PROPULSION UNIT FOR WATER CRAFT

[76] Inventor: Donald Drury, 3336 E. Mariposa, Phoenix, Ariz. 85018

[21] Appl. No.: 720,889

[22] Filed: Apr. 8, 1985

[51] Int. Cl.[4] ..... B63H 11/107

[52] U.S. Cl. ..... 440/40; 114/183 R; 440/41; 440/42

[58] Field of Search ..... 440/38, 39, 40, 41, 440/42, 43, 46, 47, 111; 114/183 R, 184; 60/221, 222

[56] References Cited

U.S. PATENT DOCUMENTS

| | | | |
|---|---|---|---|
| 3,020,872 | 2/1962 | Gierczic | 440/39 |
| 3,387,583 | 6/1968 | Kuether | 440/46 |
| 3,613,630 | 10/1971 | Jacuzzi | 114/184 X |
| 3,742,893 | 7/1973 | Stelling | 440/42 |
| 3,845,923 | 11/1974 | Atkinson | 440/111 |

FOREIGN PATENT DOCUMENTS

| | | | |
|---|---|---|---|
| 795091 | 9/1968 | Canada | 440/43 |
| 1091968 | 11/1967 | United Kingdom | 440/40 |

*Primary Examiner*—Sherman D. Basinger
*Assistant Examiner*—Paul E. Salmon
*Attorney, Agent, or Firm*—Don J. Flickinger; Jordan M. Meschkow

[57] ABSTRACT

A stream of water is caused to move through a duct carried within the hull of a water craft and is discharged as a jet in a direction which is non-directional to the craft. The jet is redirected, as by a plate or nozzle, to impart movement to the craft in a selected direction.

11 Claims, 7 Drawing Figures

FIG. 1
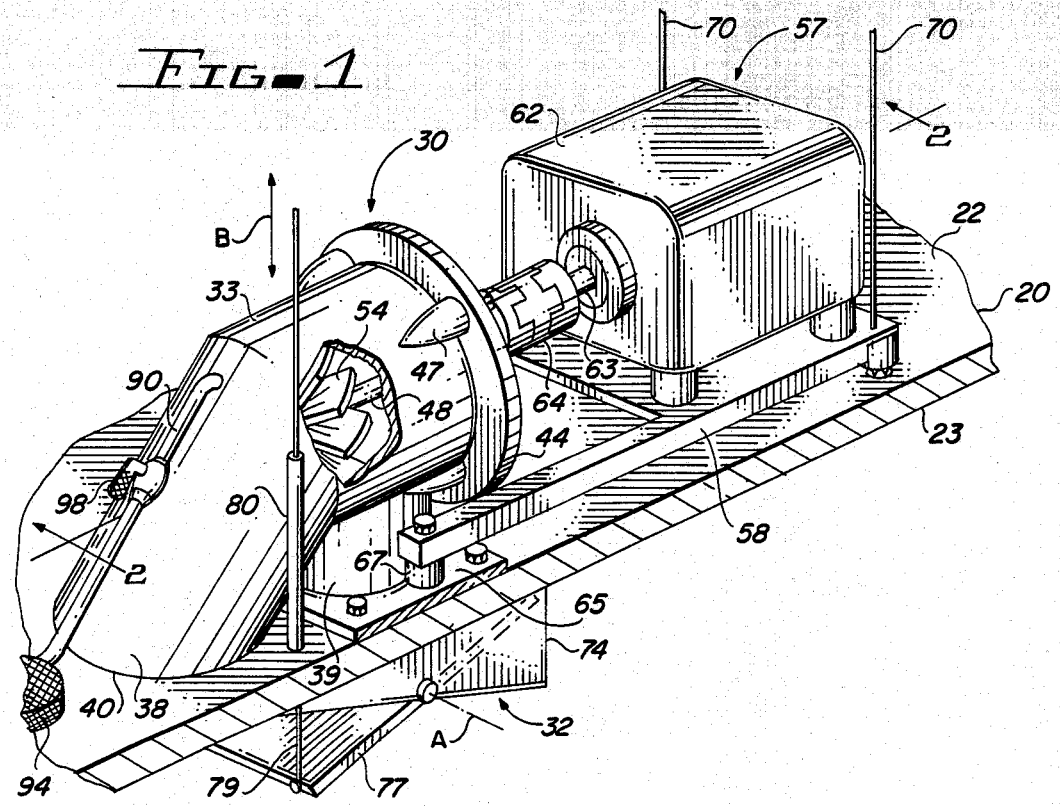
FIG. 2
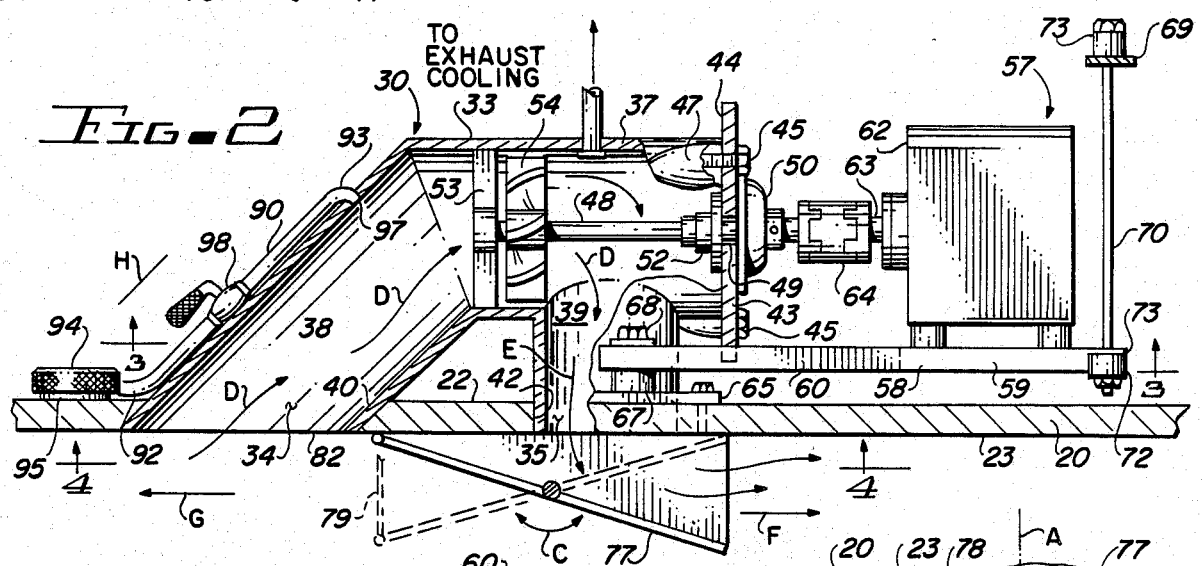
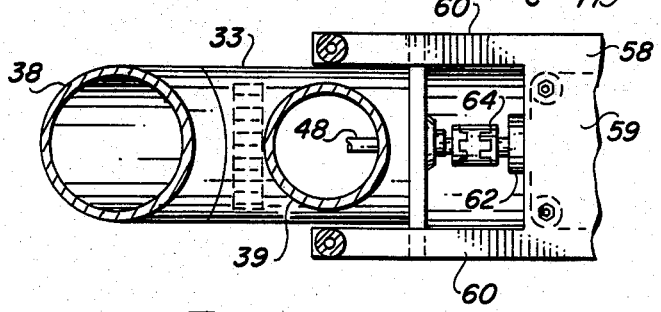
FIG. 3
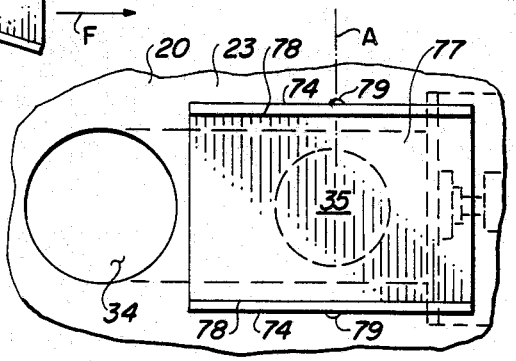
FIG. 4

FIG. 6
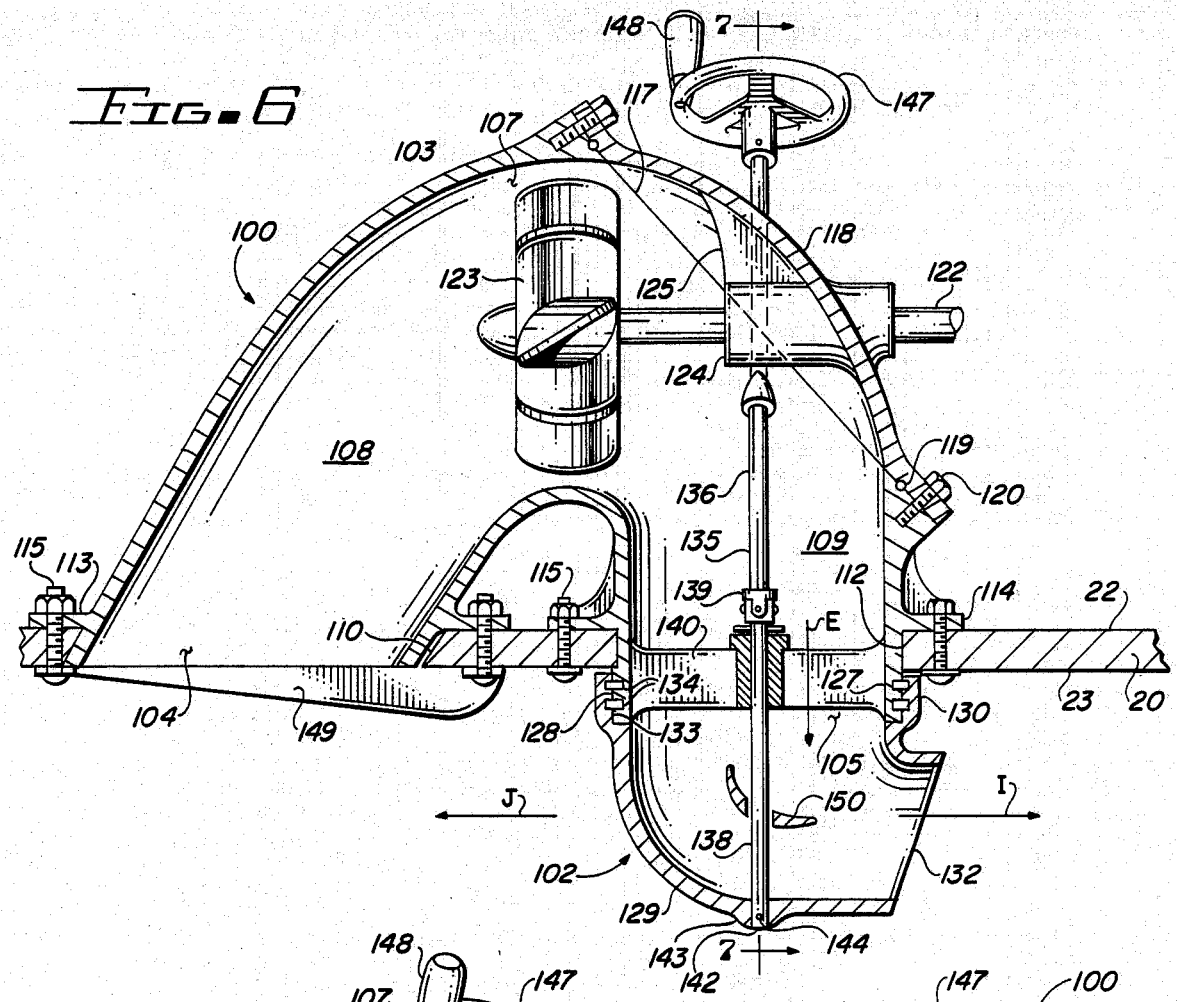
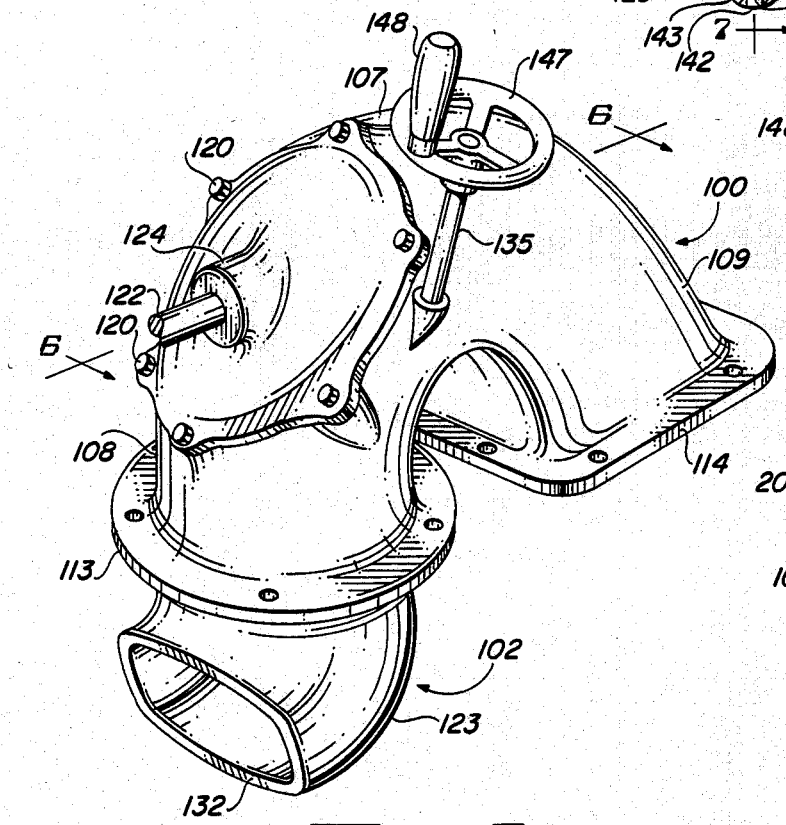
FIG. 5
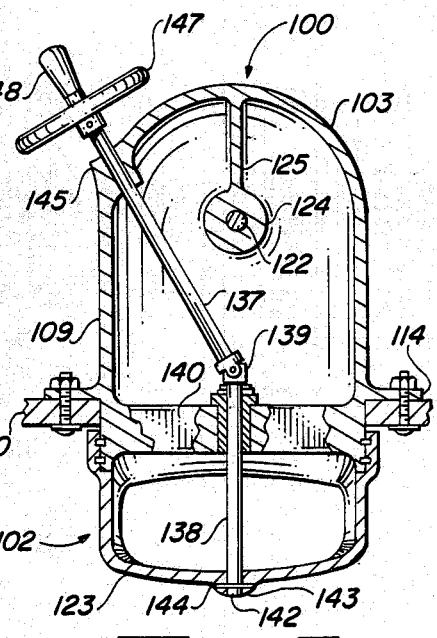
FIG. 7

PROPULSION UNIT FOR WATER CRAFT

BACKGROUND OF THE INVENTION

1. Field of the Invention

This invention relates to water craft.

More particularly, the present invention relates to means for propelling water craft.

In a further and more specific aspect, the instant invention concerns an improved propulsion unit and method for moving a water craft in selective directions over the surface of a body of water.

2. The Prior Art

The prior art is replete with various means for moving a water craft over the surface of a body of water. The more common means include manual accommodations, such as oars and paddles; fuel consuming devices, such as inboard motors, outboard motors and inboard motor/outboard drive combinations; and wind powered apparatus, such as sails.

Frequently, a water craft may be fitted with more than one means of locomotion. Generally, one of the means of locomotion, being relatively large and powerful, is considered to be the prime mover, while a second, being relatively smaller and less powerful, is intended as auxiliary power. For example, a vessel deriving primary movement from an internal combustion engine may also be equipped with an electric motor. Similarly, a comparatively compact outboard motor may be carried upon a sail boat.

Characteristically, the prime mover is capable of propelling the craft at substantial speed but with limited control. The auxiliary unit, on the other hand, while having marginal speed capabilities provides considerable manoeuverability. Conventional auxiliary units are generally cumbersome and unsightly. Consider, for example, an outboard motor secured to the stern of a sleak sailing vessel.

Functionally, the outboard motor has also proven to be less than entirely satisfactory. Steering the motor to provide drive in any selective direction within a full circle of rotation is extremely unwieldly. The effort is further complicated since many small outboard motors, of the type typically used as auxiliary power units, lack gearing necessary for selective reversing drive. Being secured to one end of the vessel, the motor cannot import lateral movement, as is desirable to sideslip the craft against a dock or pier.

Auxiliary power units are commonly used in an area of shallow water near the shore line which frequently contains swimmers. The use of a propeller, the usual thrust generating device of auxiliary power units, is extremely hazardous under these conditions. Jet propulsion drive is appropriate for shallow water use and offers the additional advantage of substantially reduced safety hazard to persons in the water. Heretofore, however, jet propulsion drive units have not been suitable as auxiliary drive.

Commonly, jet propulsion drive assemblies for marine application include a duct through which water is drawn and pressurized. The water is then discharged in a direction to cause generally forward movement of the vessel. The assemblies, substantially being replacements for traditional propellers, are incorporated into inboard and outboard units analogous to conventional design. Tending to be relatively large, bulky, and expensive prior art jet propulsion drive assemblies are best suited as prime movers.

It would be highly advantageous, therefore, to remedy the foregoing and other deficiencies inherent in the prior art.

Accordingly, it is an object of the present invention to provide improvements in the art of locomotion especially adapted for use in connection with water craft.

Another object of the invention is the provision of an improved marine drive unit of the jet propulsion type.

And another object of the invention is to provide a jet propulsion unit suitable for use as primary or auxiliary drive means.

Still another object of the immediate invention is the provision of a jet propulsion unit incorporating ameliorated directional control means.

Yet another object of the invention is to provide auxiliary drive means which can be unobstrusively incorporated into a water craft without detracting from the aesthetics.

Yet still another object of the instant invention is the provision of an improved method for propelling a vessel over the surface of a body of water.

And a further object of the invention is to provide means and method for omnidirectional control of a water craft.

Still a further object of this invention is the provision of improved means for draining water from the bilge of a water craft.

Yet a further object of the invention is to provide a simplified jet propulsion unit which may be readily retrofitted into the hull of a conventional water craft.

And still a further object of the subject invention is the provision of a drive unit that is installed in such a fashion as to substantially reduce the likelihood of theft.

Yet still a further object of the invention is to provide a drive means that is not prone to damage from underwater obstructions.

And yet a further object of the invention is the provision of means and method according to the above, which is exceedingly effective yet relatively simple and inexpensive to manufacture and operate.

SUMMARY OF THE INVENTION

Briefly, to achieve the desired objects of an improved propulsion unit for moving a water craft in selective directions over the surface of a body of water, provided are first means carried by the hull of the water craft for providing a propulsive force in a direction which is normally non-propulsive to the water craft. Second means are provided for receiving the propulsive force and selectively redirecting the force to propel the water craft in a selected direction.

In accordance with a preferred embodiment of the invention, the first means includes a duct having an inlet port for receiving water from the body of water and an discharge port. Impellent means moves the water through the duct and forceably ejects the water as a stream of water from the discharge port. Spout means adjacent the discharge port directs the stream as a jet in a direction which is normally non-propulsive to the water craft. In accordance with an immediate embodiment of the invention, the jet of water is directed in a downwardly direction substantially normal to the surface of the body of water.

The second means, in accordance with an embodiment thereof, includes gate means for receiving the jet from the spout means and redirecting the jet in first and second selective, opposed directions whereby said water craft is caused to move in respective first and second directions. In accordance with a further embodiment, the gate means may include a gate positioned below the exterior surface of the hull and progressively movable between first and second terminal positions for redirecting selective portions of the jet in the first and second directions. Further included are attachment means supporting the gate for rotation about an axis which transverse to the jet and control means for selectively rotating the gate about the axis between the first and second terminal positions.

In accordance with an alternately preferred embodiment of the invention, the second means includes a nozzle having an inlet for receiving the jet from the sprout means and an outlet residing below the exterior surface of the hull for redirecting the jet in a direction to impart movement to the water craft and guidance means for controlling the direction in which the jet is discharged from the outlet of the nozzle. Preferably, the nozzle is rotatable about an axis which is substantially parallel to the direction in which the jet is discharged from the spout means. Further included are steering means for controllably rotating the nozzle about the axis. The steering means may include a steering wheel having indicator means for indicating the direction of movement of the water craft in response to rotation of the nozzle.

The instant invention also provides a bilge drain apparatus for use in connection with jet propulsion drive means for evacuating the bilge of a water craft in response to the movement of the stream of water through the duct of the drive means. In accordance with an embodiment thereof, the drain apparatus includes a hollow probe for residing at a low pressure area within the stream of water, pickup means residing within the bilge, and a conduit communicating between the probe means and the pickup. In a further embodiment, the drain apparatus includes valve means for selectively and alternately inhibiting or permitting the draw of fluids through the conduit.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 1 is a perspective view of an improved propulsion unit constructed in accordance with the teachings of the instant invention as it would appear when installed in a water craft, the water craft being represented by a fragmentary section of the hull;

FIG. 2 is a vertical sectional view taken along the line 2—2 of FIG. 1 and further revealing internal details of the improved propulsion unit;

FIG. 3 is a horizontal fragmentary sectional view on a reduced scale taken along line 3—3 of FIG. 2;

FIG. 4 is a horizontal fragmentary sectional view on a reduced scale taken along the line 4—4 of FIG. 2;

FIG. 5 is a perspective view of an alternate improved propulsion unit embodying the teachings of the instant invention;

FIG. 6 is an enlarged vertical sectional view taken along the line 6—6 of FIG. 5; and FIG. 7 is a reduced scale vertical sectional view taken along the line 7—7 of FIG. 6.

DETAILED DESCRIPTION OF THE PREFERRED EMBODIMENTS

Turning now to the drawings, in which like reference characters indicate corresponding elements throughout the several views, attention is first drawn to FIG. 1 which illustrates an embodiment of an improved propulsion unit of the instant invention as it would appear when installed in a water craft. The water craft is represented by the fragmentary section of the hull 20 having interior surface 22 and exterior surface 23. For purposes of illustration, section 20 is assumed to be a lower portion of the hull such that the area adjacent surface 22 is that portion generally referred to as the bilge. Exterior surface 23 is in contact with the body of water upon which the craft floats. Section 20 being substantially horizontal and planar is considered, for purposes of orientation, to be substantially parallel to the plane of the normal surface of the body of water.

The foregoing cursory description of the water craft is set forth for clarity of understanding of the ensuing description of the invention. Further and more specific details of the craft, not herein illustrated not described, will be readily apparent to those skilled in the art. It will be further appreciated that hull configurations vary from water craft to water craft and accordingly, especially in water craft having an exceedingly deep V hull, it may be necessary to provide an auxiliary platform for the mounting of the propulsion unit of the instant invention.

The illustrated propulsion unit comprises first means, generally designated by the reference character 30 residing primarily interiorly of the hull and second means, generally designated by the reference character 32, residing primarily exteriorly of the hull. First means 30 provides a propulsive force in a direction which is normally considered to be non-propulsive to the water craft. Second means 32 receives the propulsive force from the first means and selectively redirects the force to propel the water craft in a selected direction. Each means will be described below with sufficient clarity and detail for the understanding of those skiled in the art.

First means 30, as further seen in FIG. 2, includes a duct 33 extending between inlet port 34 and discharge port 35. Being generally in the shape of an inverted U, duct 33 includes an intermediate section 37, which functions as an impeller housing, an inlet section 38 extending between inlet port 34 and intermediate section 37 and a discharge section 39 extending between intermediate section 37 and discharge port 35. The terminal portions of inlet section 38 and discharge section 39 extend through openings 40 and 42, respectively, of appropriate size and shape. For purposes of waterproofing, each section is sealed within the respective opening in accordance with conventional techniques.

Intermediate section 37, as illustrated in the immediately preferred embodiment of the invention, is substantially horizontal or generally parallel to the section of hull 20. In addition to the openings communicating with inlet section 38 and outlet section 39 to provide for continuity of the conduit 33, intermediate section 37 further includes an open end 43 residing at a location beyond discharge section 39. Cover plate 44 normally closes open end 43 by virtue of a plurality of bolts 45 which extend through openings in plate 44 and threadedly engage bosses 47 carried by intermediate section 37.

A drive shaft 48, having an axis of rotation substantially coincident with the longitudinal axis of intermediate section 37, extends through plate 44 and is rotatably journaled therein by bearing 49. Assemblies 50 and 52 secured to drive shaft 48 on the external and internal sides, respectively, of plate 44 function as water tight seals and as thrust bearings in accordance with conventional procedure. Drive shaft 48 is also rotatably journaled in bearing support 53. Although not specifically illustrated in detail, it will be appreciated that bearing support 53 is of conventional design having a central hub carrying a commercially available bearing and supported in "spider web fashion" by two or more relatively thin arms extending outwardly and secured to intermediate section 37. A conventional water turbine or impeller 54 is affixed to drive shaft 48. It is noted that impeller 54 resides downstream of discharge section 39.

Drive means, generally designated by the reference character 57, imparts rotary motion to drive shaft 48. Drive means 57 includes support plate 58 which, as further seen in FIG. 3, has a pad portion 59 with a pair of spaced apart forwardly extending arms 60. Arms 60 are spaced apart to receive duct 33 therebetween. A suitable power plant 62, such as an electric motor or internal combustion engine, is mounted in conventional manner upon pad portion 59. Output shaft 63 extends from power plant 62 and is coupled to drive shaft 48 by means of a conventional flexible coupling 64.

Support plate 58 is secured by means which dampen vibration transmitted from power plant 62 to the water craft and which provide for adjustment for alignment between output shaft 63 and drive shaft 48. To minimize modification to the hull, a portion of support plate 58 is borne by the mounting flange projecting from discharge section 39. A resilient grommet 67 resides between each arm 60 and the flange 65. A bolt 68 extending through openings in the arm 60 and the grommet 67 is threadedly coupled with flange 65. Neither of the openings are shown. However, grommets for this purpose are commercially available and the assembly will be readily understood by those skilled in the art.

The other end of support plate 58 is similarly supported. A pair of mounting brackets 69 are affixed to the hull by any suitable manner in accordance with conventional technique. Each mounting bracket 69 resides at an elevated location in approximate alignment with a corner of the free end of pad portion 59. A bolt 70 extends through an opening in each mounting bracket 69 and the respective corner of pad portion 59. A nut 72 is affixed to one end of the bolt 70. A grommet 73, generally analogous to the previously described grommet 67, resides on top of each mounting bracket 69 under the head of the respective bolt 70. Another grommet 73 is sandwiched between the underside of support plate 58 and the nut 72. Rotation of nut 74 relative bolt 70 effectively shortens or lengthens bolt 70 for angular adjustment of output shaft 63 relative drive shaft 48. The entire support plate 58 may be raised or lowered by varying the thickness of grommet 67. Lateral adjustment of output shaft 63 relative drive shaft 48 is accomplished by providing pad 59 with laterally elongate slots which accommodate the bolts by which power plant 62 is secured to support plate 58. As will be appreciated by those skilled in the art, many power plants of commercially available design incorporate a mounting flange having elongate slots for alignment purposes.

Second means 32, as seen with further reference to FIG. 4, includes a pair of generally triangular plates 74 which depend from hull 20. Plates 74 are generally parallel and spaced apart to reside outboard of discharge port 35. A gate, in the form of generally rectangular plate 77 resides intermediate triangular plates 74. Longitudinal edges 78 of plate 77 reside in close proximity to the interior surfaces of respective plates 74. A pivot pin 79 projects from each edge 78 and is rotatably journaled within the respective plate 74. Accordingly, plate 77 is rotatable about the lateral axis illustrated by the broken line designated A.

Cable 79 encased in sheath 80, a commercially available device, is attached at one end to plate 77. Although not specifically herein illustrated, it will be appreciated that a handle preferably located for convenience of the operator is fixed to the other end of cable 79. By pulling or pushing upon the handle, cable 79 is movable in reciprocal directions as indicated by the double arrowed line B. Accordingly, plate 77 is reciprocally rotatable about axis A, in directions indicated by the double arrowed arcuate line C as seen in FIG. 2 between a first terminal position shown in solid outline and a second terminal position shown in broken outline.

The operation and function of the previously described propulsion unit will now be set forth with particular reference to FIG. 2. In response to rotation of impeller 54 a moving stream of water traveling in the direction indicated by the arrowed lines D is caused to pass through duct 33. Water from the body of water upon which the water craft rests is drawn in through inlet 34. Screen 82 extending across inlet port 34 prevents the entrance of debris or other particles which may damage impeller 54. The moving stream of water is discharged as a high pressure jet through discharge port 35. Discharge section 39, functioning as a spout, directs the jet of water in the direction indicated by the arrowed line E which is substantially vertically downward. Being substantially normal to the surface of the body of water, the force of the jet is in a direction which is normally non propulsive to the water craft.

Triangular plates 74 function as attachment means for pivotally mounting gate 77 below the exterior surface 23 of hull 20. Cable 79 and sheath 80 function as control means for selectively rotating gate 77. The entire assembly functions as gate means for receiving the jet of water from discharge port 35 and redirecting selective portions of the jet in selective directions. With plate 77 in the position shown in solid outline in FIG. 2, all of the jet is redirected in the direction indicated by the arrowed line F resulting in movement of the water craft in the direction indicated by the arrowed line G. Plates 74 insure that the total force of the jet is converted to energy for moving the water craft. When in the broken line position, plate 77 redirects the jet in the direction of arrowed line G urging movement in the direction of arrowed line F. When gate 77 is at an intermediate position and selective portions of the jet are redirected in each of the directions to crate an equilibrium of forces, no propulsive force is imparted to the water craft. It is apparent, therefore, that the speed of the water craft in either direction is controllably variable in response to the angle of the gate between the intermediate position and the respective terminal position. It is equally apparent that rotation of the gate beyond the intermediate position will have a breaking effect upon the water craft. The direction of movement of the craft, the speed in the chosen direction and the braking effect is exclusive of the speed of impeller 54. Accordingly, drive means 57, if desired, can be preset to function at a given speed.

Further provided by the instant invention is a bilge drain apparatus for evacuating fluids, such as water, gasoline and fumes, from the bilge of a water craft. As will be appreciated by those skilled in the art, an area of low pressure is created within duct 33 upstream of impeller 54, especially in inlet section 38. In accordance with a preferred embodiment as seen with particular reference to FIG. 2, the bilge drain apparatus of the instant invention includes a conduit 90 having inlet and outlet ends 92 and 93, respectively, and lying in juxtaposition with inlet section 38. Pickup means in the form of receptable 94 having screened opening 95 in close proximity to interior surface 22 of hull 20 is secured to inlet end 92. Open end 93, being angularly disposed, passes through and is seamingly engaged with opening 97 extending through conduit 33. Pet cock 98 is placed in series with conduit 90 intermediate the ends 92 and 93.

Open end 93 functions as hollow probe means residing at a low pressure area naturally created within the moving stream of water. As a result thereof, a continuous vacuum is created in conduit 90. Accordingly, fluids within the bilge are drawn into opening 95 and through conduit 90 in the direction of arrowed line H. Exiting outlet 93, the fluids are entrained within the moving stream of water to be discharged through discharge port 35. Pet cock 98 provides for selectively and alternately inhibiting or permitting the draw of fluids through conduit 90.

Turning now to FIG. 5, there is seen an alternate embodiment of a propulsion unit incorporating the principles of the instant invention. In general similarity to the previously described embodiment, the immediate embodiment includes first means 100 and second means 102 for purposes hereinbefore described.

With further reference to FIG. 6, it is seen that first means 100, being generally analogous to previously described first means 30, includes duct 103 extending between inlet and outlet ports 104 and 105, respectively, having intermediate section 107 inlet section 108 and discharge section 109. Duct 103 is generally in the form of an inverted U with ports 104 and 105 extending through openings 110 and 112, respectively, in hull 20. Annular flange 113 projects from inlet section 108 and annular flange 114 projects from outlet section 109. The flanges are secured to hull 20, or a platform within hull 20 for the purpose, by any conventional means such as bolt 115. As noted, the several sections 107, 108 and 109 are joined and blended to form a continuously curving interior surface.

Opening 117, normally closed by cover 118, is formed in duct 103. Annular seal 119, residing in a suitable groove, and a plurality of bolts 120, for which appropriately spaced bosses are provided, retain cover 118 and sealing engagement with duct 103. Drive shaft 122, having impeller 123 affixed thereto, extends through cover 118. Drive shaft 122 is supported in cover 118 by conventional sealing and bearing arrangement as will be appreciated by those skilled in the art. The bearing and seal arrangement is carried within boss 124, an integral part of cover 118. One or more gussetts 125 may be employed for stability and rigidity of boss 124. In the immediate illustration, shaft 122 is broken away exteriorly of duct 103. It is to be understood that shaft 122 is coupled with an appropriate drive means, such as previously described drive means 57.

Second means 102, while performing the same general function, represents a structural variation of the previously described first means 32. In accordance with the immediate embodiment, outlet section 109 includes a terminal portion 127 projecting below exterior surface 23 of hull 20 and having an outer cylindrical surface 128. Nozzle 129, which redirects the jet of water from outlet 105 of duct 103, includes inlet end 130 and outlet 132. Internal of cylindrical surface 133 is rotatably journaled upon outer cylindrical surface 128 and is secured thereto by any conventional means such as slip rings 134. Outlet end 132 is substantially rectangular in cross-section, having a greater width than height, to minimize the projection below hull 20. In general analogy to gate 77, nozzle 129 receives the jet of water along an axis which is substantially normal or perpendicular to the surface of the body of water and discharges the jet of water along an axis which is substantially parallel to the surface of the body of water.

Steering means for controllably rotating nozzle 129 includes steering shaft 135 having upper section 137 and lower section 138 joined by flexible coupling 139. Lower section 138, which extends along the axis of rotation of nozzle 129, is rotatably journaled in strut 140 and is secured to nozzle 129. In accordance with an immediately preferred embodiment of the invention, lower end 142 of lower section 138 is received within projection 143 carried by nozzle 129.

Upper section 137, as best viewed in FIG. 7, is angled laterally to extend through conduit 103 and avoid cover 118. At the location at which section 137 extends through, duct 103 is reinforced by boss 145. Upper section 137 is rotatably journaled within boss 145. Although not specifically herein illustrated, a conventional seal or packing gland may be used to affect a watertight seal between boss 145 and upper section 137. A handle 147 having an upstanding hand grip 148 is drivingly engaged to upper section 137 exteriorly of duct 137.

As previously noted, the function of first means 100, including duct 103 and impeller 123, is to draw water from the body of water then discharge the water as a downwardly directed jet as represented by the arrowed line E. To prevent the induction of debris and other items which may damage impeller 123, a grill in the form of a plurality of spaced parallel ribs 149 extend over inlet port 104. Preferably, the ribs 149 are oriented in afore and aft direction. The purpose of second means 102, including nozzle 129, shaft 135 and handle 147, is to redirect the jet in a direction indicated by the arrowed line I to impart motion to the water craft as represented by the arrowed line J. Fin 150 assists in redirecting the jet from the direction indicated by the arrowed line E to the direction indicated by the arrowed line A.

The exit direction of the jet, indicated by the arrowed line I, is infinitely variable within a plane which is substantially parallel to the surface of the body of water upon which the water craft rests. Steering rotation of nozzle 129 is by means of manual manipulation of handle 147 and hand grip 148 by the operator of the craft. Hand grip 148 is located upon handle 147 to coincide with the direction indicated by the arrowed line J. Accordingly, the operator is aware at all times of the intended direction of travel of the craft in response to propulsion by the propulsion unit of the immediate invention. This is especially important when the device is used as an auxiliary power unit. In view of the foregoing, it will be appreciated that lateral movement of the craft, a condition especially desirable to assist in docking the craft, can be achieved by placing the propulsion unit of the instant invention proximate the center of inertia of the water craft.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described and disclosed the instant invention and alternate embodiments thereof in such clear and concise terms as to enable those skilled in the art to understand and practice the same, the invention claimed is:

1. An improved propulsion unit especially adapted for use in combination with a water craft, which water craft is adapted for flotation upon a body of water and is capable of movement in directions lying in a plane substantially parallel to the surface of said body of water, and which water craft includes a hull having a substantially horizontal and longitudinally planar bilge portion, which bilge portion has an interior surface and an exterior surface residing below the surface of said water, and for moving said water craft in selective directions, said propulsion unit comprising:

a. first means carried by said portion of said hull for providing a propulsive force in a direction which is normally non-propulsive to said water craft, said first means comprising:

i. a duct having an inlet port for receiving water from said body of water, and a discharge port, said duct being generally in the shape of an inverted u and having an inlet section, an outlet section, and an intermediate section;

ii. impellent means for moving said water through said duct and forceably ejecting said water as a stream of water from said discharge port, said impellent means including:

an impeller residing within said duct intermediate said inlet port and said discharge port;

drive means located to the rear of said impeller for imparting rotary motion to said impeller; and a driven shaft rotatably journaled in said duct and having an internal end residing within said duct and coupled to said impeller, and having an external end projecting rearward from said duct and coupled to said drive means; and iii. spout means adjacent said discharge port for directing said stream of water as a jet in a direction which is normally non-propulsive to said watercraft, said inlet port and said discharge port projecting through said substantially horizontal bilge portion of said hull; and b. second means for receiving said propulsive force and selectively redirecting said force to propel said watercraft in a selected direction, said second means comprising:

i. a nozzle residing below the exterior surface of said hull and having an inlet for receiving said stream of water from said spout means and having an outlet for discharging said stream of water in a direction to impart movement to said watercraft, said nozzle being rotatable about an axis of rotation which is substantially parallel to the direction in which said stream of water is discharged from said spout means: and ii. steering means for controllably rotating said nozzle about its axis of rotation, said steering means comprising:

a lower steering shaft having a first end fixidly coupled to said nozzle and having a second end, said lower steering shaft extending along the axis of rotation of said nozzle;

an upper steering shaft angled laterally and having a first end flexibly coupled to the second end of said lower steering shaft and having a second end projecting exteriorly of said duct; and a rotatable steering handle fixidly coupled to said second end of said upper shaft and residing exteriorly of said duct.

2. The improved propulsion unit of claim 1, wherein said propulsive force is the reaction to a projected stream of water.

3. The improved propulsion unit of claim 2, wherein said first means projects said stream of water in a downwardly direction substantially normal to the surface of said body of water.

4. The improved propulsion unit of claim 3, wherein said second means projects said stream of water in selective outward directions substantially radial with reference to said downwardly direction.

5. The improved propulsion unit of claim 1, wherein said spout means directs said stream of water in a downwardly direction substantially normal to the surface of said body of water.

6. The improved propulsion unit of claim 1, wherein said drive emans includes:

a. motor means havng an output drive shaft; and b. coupling means flexibly coupling said drive shaft to said driven shaft.

7. The improved propulsion unit of claim 6, further including alignment means for selectively and adjustably aligning said drive shaft with said driven shaft.

8. The improved propulsion unit of claim 7, wherein said alignment means further including damper means for damping vibration of said motor means transmitted to said water craft.

9. The improved propulsion unit of claim 1, wherein said nozzle means directs said stream of water in a direction which is generally radial to the direction in which said stream of water is discharged from said spout means.

10. The improved propulsion unit of claim 9, wherein the inlet of said nozzle is rotatably coupled with the discharge port of said duct.

11. The improved propulsion unit of claim 10, further including indicator means carried by said steering handle for indicating the direction of movement of said water craft in response to rotation of said steering wheel.

* * * * *